US007744327B2

(12) United States Patent
Lops et al.

(10) Patent No.: US 7,744,327 B2
(45) Date of Patent: Jun. 29, 2010

(54) TUBULAR HANDLING APPARATUS AND A DRILLING RIG

(75) Inventors: Johan Lops, Rotterdam (NL); Jacobus Franciscus van Rijn, Werkendam (NL); Michiel Cornelis Kloosterboer, Haarlem (NL)

(73) Assignee: Itrec B.V., Schiedam (NL)

( * ) Notice: Subject to any disclaimer, the term of this patent is extended or adjusted under 35 U.S.C. 154(b) by 208 days.

(21) Appl. No.: 11/663,549

(22) PCT Filed: Oct. 7, 2004

(86) PCT No.: PCT/NL2004/000705

§ 371 (c)(1),
(2), (4) Date: Jul. 27, 2007

(87) PCT Pub. No.: WO2006/038790

PCT Pub. Date: Apr. 13, 2006

(65) Prior Publication Data

US 2008/0253866 A1 Oct. 16, 2008

(51) Int. Cl.
*E21B 19/00* (2006.01)
*H01L 21/68* (2006.01)

(52) U.S. Cl. ..... 414/22.52; 414/22.55; 414/783; 414/742; 901/21; 901/22

(58) Field of Classification Search ..... 166/77.52; 175/162, 85; 212/293, 305; 414/22.51, 22.54, 414/22.55, 22.62, 22.67, 23–24, 733–735, 414/738, 740, 742, 745.2, 746.8, 917; 74/490.01, 74/490.05

See application file for complete search history.

(56) References Cited

U.S. PATENT DOCUMENTS 3,094,228 A * 6/1963 Peterson ..... 414/688
3,177,944 A * 4/1965 Knights ..... 166/77.53
3,633,771 A * 1/1972 Woolslayer et al. ..... 414/22.55
3,774,781 A * 11/1973 Merkley ..... 414/23

(Continued)

FOREIGN PATENT DOCUMENTS

GB 2 080 857 2/1982

(Continued)

OTHER PUBLICATIONS

W. P. Boyle and K. Liu, The Fourbar Linkage: Pseudographic Kinematic Analysis, 1997, TEMPUS Publications, Int. J. Engng Ed. vol. 13, No. 4, pp. 262-268.*

*Primary Examiner*—Gregory W Adams
(74) *Attorney, Agent, or Firm*—Birch, Stewart, Kolasch & Birch, LLP

(57) ABSTRACT

The invention relates to a tubular handling apparatus for moving tubulars between a substantially horizontal transfer station and a second transfer station. The apparatus comprises a base and a boom, rotatable with respect to the base between a lowered position and a raised position by boom rotation drive means in a boom rotation direction around a horizontal boom rotation axis. Furthermore, the apparatus comprises a gripper, rotatably attached to the boom and adapted for gripping the tubular, which gripper is rotatable about a gripper rotation axis by a gripper rotation drive means in a gripper rotation direction. According to the invention, the gripper rotation axis is parallel to and spaced from the horizontal boom rotation axis and in that the gripper rotation drive means provide a gripper rotation direction opposite to the boom rotation direction.

24 Claims, 7 Drawing Sheets

U.S. PATENT DOCUMENTS

Figure 1:
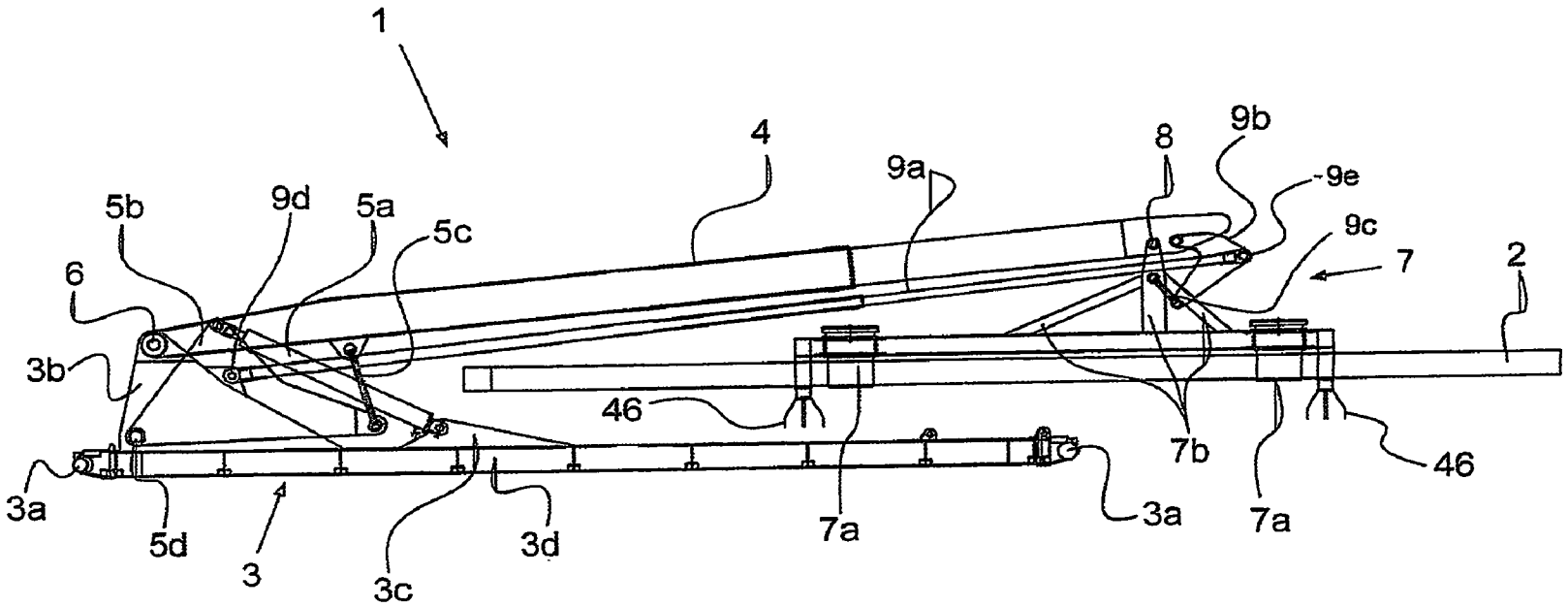

| | | | | | |
|---|---|---|---|---|---|
| 3,986,619 | A | | 10/1976 | Woolslayer et al. | |
| 3,991,887 | A | * | 11/1976 | Trout | 414/22.52 |
| 4,822,230 | A | * | 4/1989 | Slettedal | 414/22.54 |
| 4,834,604 | A | * | 5/1989 | Brittain et al. | 414/22.55 |
| 5,180,955 | A | * | 1/1993 | Karidis et al. | 318/568.1 |
| 5,183,366 | A | * | 2/1993 | Paech | 414/22.52 |
| 5,464,307 | A | | 11/1995 | Wilkins | |
| 6,220,807 | B1 | | 4/2001 | Sorokan et al. | |
| 6,309,171 | B1 | * | 10/2001 | Arck et al. | 414/706 |

FOREIGN PATENT DOCUMENTS

| | | | |
|---|---|---|---|
| WO | WO-99/43920 | A1 | 9/1999 |

* cited by examiner

TUBULAR HANDLING APPARATUS AND A DRILLING RIG

The present invention relates to an improved tubular handling apparatus for moving tubulars between a substantially horizontal transfer station and a second transfer station, e.g. a substantially vertical second transfer station. The apparatus comprises a base and a boom, rotatable with respect to the base between a lowered position and a raised position by boom rotation drive means in a boom rotation direction around a horizontal boom rotation axis. Furthermore the apparatus comprises a gripper, rotatably attached to the boom and adapted for gripping the tubular, which gripper is rotatable about a gripper rotation axis by a gripper rotation drive means in a gripper rotation direction.

From GB 2 080 857—on which the preamble of claim 1 is based—a tubular handling apparatus is known for raising and lowering tubulars in a drilling rig between a horizontal position, in which the tubulars are transported and stored on a rack, and the vertical position, in which the tubular is aligned with the drilling rig structure and a drill string handled by said drilling rig. In this known apparatus the tubular is gripped by two rotatably mounted clamps which are rotatable around a rotation axis parallel to the boom. The clamps are rotatable between a side loading position, to facilitate loading and unloading in the horizontal position and a central position, in which a clamped tubular is aligned with the drilling axis or firing line of the drilling rig when the boom is in the vertical position. The clamps are rotated by hydraulic cylinders that can be operated automatically by a hydraulic sequencing circuit into the side loading position whenever the boom is pivoted with a tubular in the clamp. The boom is pivotable between a vertical position parallel to the drilling tower and a horizontal position by a boom cylinder.

The apparatus known from GB 2 080 857 is unsatisfactory. It is therefore an object of the invention to provide an improved apparatus for handling tubulars.

The invention achieves this object by providing an apparatus for handling tubulars according to the preamble of claim 1, wherein the gripper rotation axis is parallel to and spaced from the horizontal boom rotation axis and the gripper rotation drive means provide a gripper rotation direction opposite to the boom rotation direction.

With the inventive apparatus a horizontal orientated tubular can be picked up from a storage rack or the like and with one "combined motion" brought into the second transfer station, e.g. in a substantial vertical position at an elevated level, or vice versa.

To facilitate loading and unloading in the lowered position of the boom the gripper is then preferably located below the boom. When the boom is the raised towards a more vertical position the gripper is rotated to the other side of the boom in an anti-clockwise direction to the boom rotation direction.

The tubular handling apparatus can be employed for land-based (drilling) applications, but also offshore (drilling and marine pipe laying) application, e.g. wherein the apparatus is based on a (semi-submersible, monohull) drilling or pipe laying vessel or offshore drilling rig (such as a jack-up platform), are possible.

The apparatus allows bringing the tubular in the second transfer station, which can have a vertical or near vertical orientation but also an inclined orientation (e.g for inclined drilling operations). In the second transfer station the tubular is released from the gripper and transferred to another piece of equipment. For instance the tubular is transferred to an alignment means for aligning the tubular with the drill string in the drilling axis of the drilling rig. In the second transfer station the tubular could be oriented vertically, preferably at an angle of at least 45°, more preferably at least 55° with the horizontal, e.g. for inclined drilling.

In a practical situation the substantially horizontal transfer station is a tubular storage station and the second transfer station is one of a drilling rig structure, a pipe laying system structure, a crane etc. The crane can be combined with another structure, such as forming part of a drilling rig for transferring the tubular from the second transfer station to a position aligned with the firing line (the drill string) of the drilling rig. It is also possible to store the tubulars vertically and raise them subsequently into a horizontal transfer position, e.g. when tubulars are stored vertically in a leg of a semi-submersible vessel.

The tubulars that can be handled with the tubular handling apparatus according to the invention can be any type of tubular: oil well and water well tubulars and rods, drill pipes, drill collars, casings, production tubing, sucker rods, pump column pipes, logging tools, bottom hole assembly, pipeline joints, etc.

The tubular handling apparatus can be operated at a relatively high speed e.g. in order to maximise the efficiency of drilling operations.

An advantage of this apparatus according to the invention is that the apparatus can be designed very safe, due to its stable construction and pre-defined trajectory of the tubular.

In a preferred embodiment, the apparatus can work very fast when the boom rotation and the gripper rotation take place essentially simultaneously. Hereto, the boom rotation drive means and the gripper rotation drive means are adapted to operate simultaneously. The tubular is moved simultaneously in the boom rotation direction from the lower position to the raised position and in the gripper rotation direction.

In a preferred embodiment, the boom comprises two, preferably parallel beams between which the gripper and the gripped tubular can pass. Preferably, a crossbeam is provided at the ends of the two beams remote from the base. The thus created U-shape boom structure provides a very stable construction. However, the boom can also be e.g. a single beam or A-frame.

In a preferred embodiment the gripper rotation drive means comprise a kinematic linkage assembly arranged between the base and the gripper and connected to the boom. The boom rotation drive means require at least one actuating device, but to drive the gripper rotation no additional hydraulic or electronic drive means are necessary. Hence, only a boom actuating device is needed to perform both the motions of the boom and of the gripper. This reduces maintenance and risk of damage.

Preferably, the boom rotation drive means comprise one or more hydraulically actuated cylinders. The boom rotation drive means could as alternative comprise a winch and cable, a hydraulic rotary actuator, etc.

In a preferred embodiment the gripper rotation drive means comprise at least one rod, extending along the boom, connected with one end to the base and with the other end to the gripper. The gripper rotation drive means further comprise a rod linkage member, linking the boom and the rod, and the gripper, possibly via a gripper linkage member, linking the rod linkage member to the gripper.

Preferably, the rod linkage member is a plate, and preferably, the gripper linkage member is a rod.

In another preferred embodiment, the boom rotation drive means comprise a base linkage member that is pivotably connected to the base and to a part of the boom remote from the boom rotation axis, and in which one or more actuators are arranged between the base and the base linkage member. This allows for a geometrical optimal design of the boom rotation drive means, in particular in view of the dimensions of the apparatus which has its effect on the transportability of the apparatus. Another advantage of the linkage member is to optimise loads acting on the apparatus.

In another preferred embodiment that can easily be transported the tubular handling apparatus is telescopic to the size of an ISO freight container, preferably a 40 feet container. Advantageously, the base of the tubular handling apparatus is designed as part of an ISO freight container and has ISO freight container corner fittings. Preferably, the container of the tubular handling apparatus can be coupled to another ISO freight container, preferably a 40 feet container to form a complete platform.

Preferably, the boom is telescopic and the rod of the gripper rotation drive means is telescopic, to facilitate transportation as well as assembly and disassembly on site.

The invention relates also to a drilling rig, comprising a drilling rig structure and an associated tubular transfer station, provided with a hoisting device for raising and lowering a string of interconnected tubulars, and provided with a tubular storage station and a substantial horizontal tubular transfer station, the drilling rig further being provided with a tubular handling apparatus.

The invention relates also to a marine pipe laying system comprising pipe lay tower and an associated tubular transfer station, provided with a tubular storage station and a substantially horizontal tubular transfer station, the marine pipe lay system further being provided with a tubular handling apparatus for moving tubulars, generally pipe joints, between the storage and the tower.

Furthermore, the invention relates to a method for handling tubulars between a substantially horizontal transfer station and a second, possibly substantially vertical oriented, transfer station. The method comprises the steps of gripping the tubular by a gripper, that is rotatably attached to a boom, rotating the boom with respect to a base between a lowered position and a raised position around a horizontal boom rotation axis, and rotating the gripper about a gripper rotation axis, characterised in that the gripper rotation axis is parallel to and spaced from the horizontal boom rotation axis and in that the gripper rotation direction is opposite from the boom rotation direction. This method can be, for example, part of a drilling operation or of a pipe laying operation.

The invention will be best understood by reference to the following detailed description taken in connection with the accompanying drawings.

Figure 2:
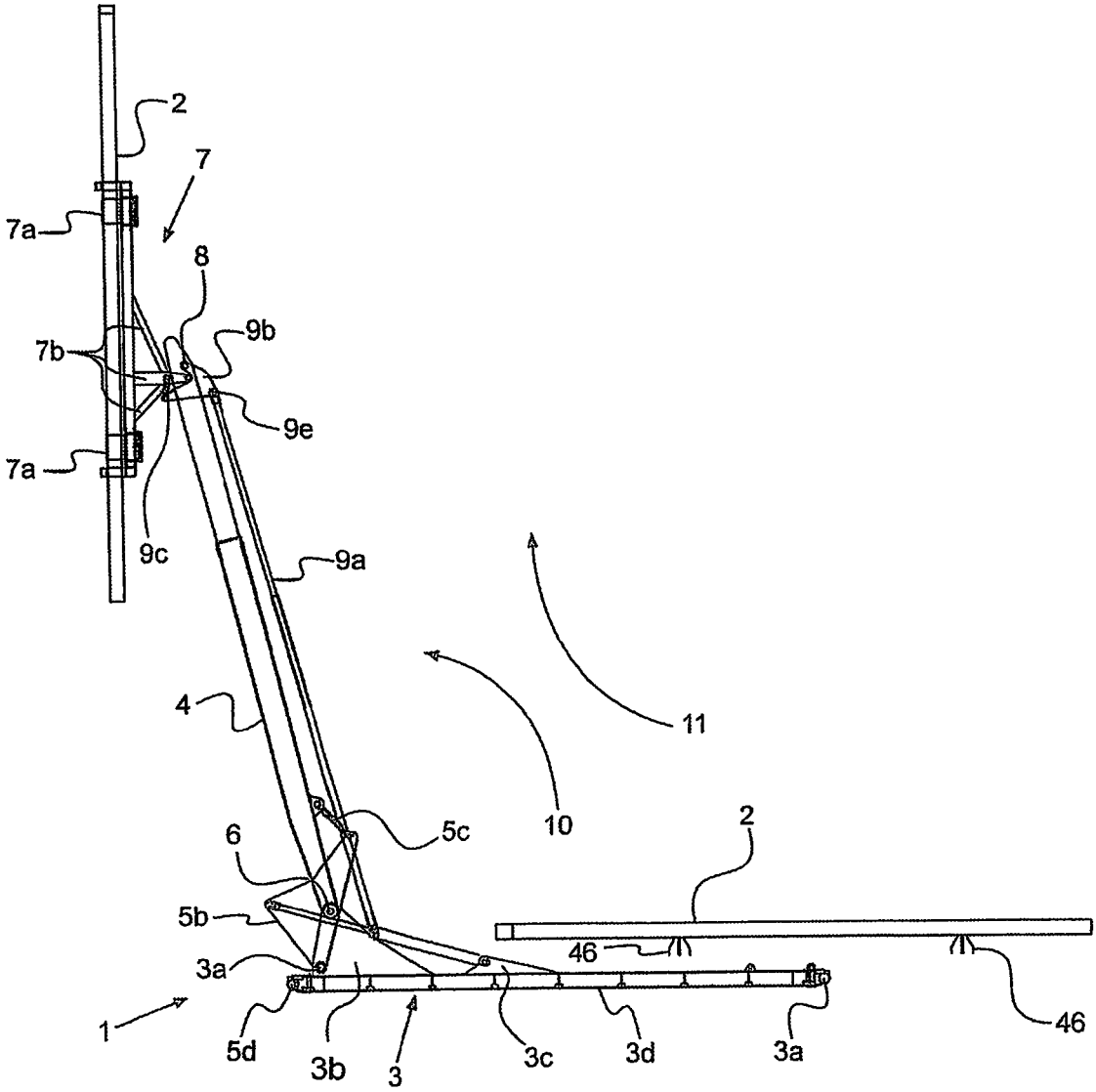
Figure 3:
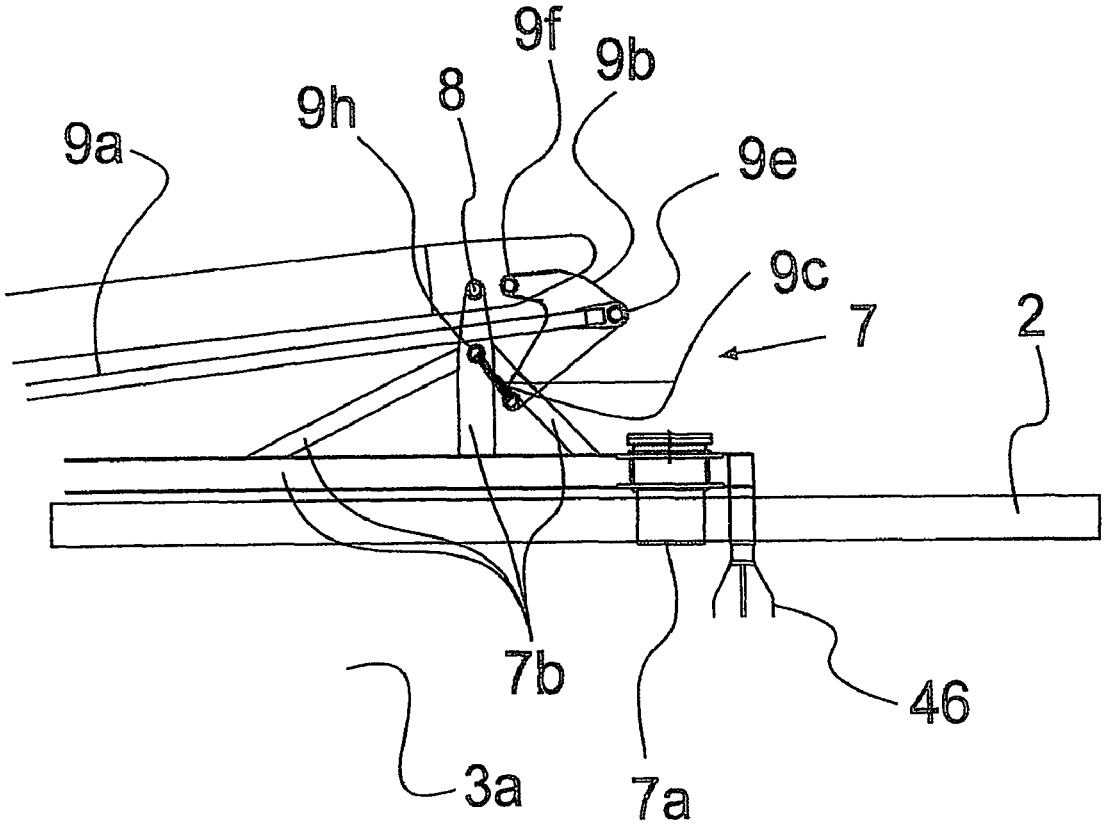
Figure 4:
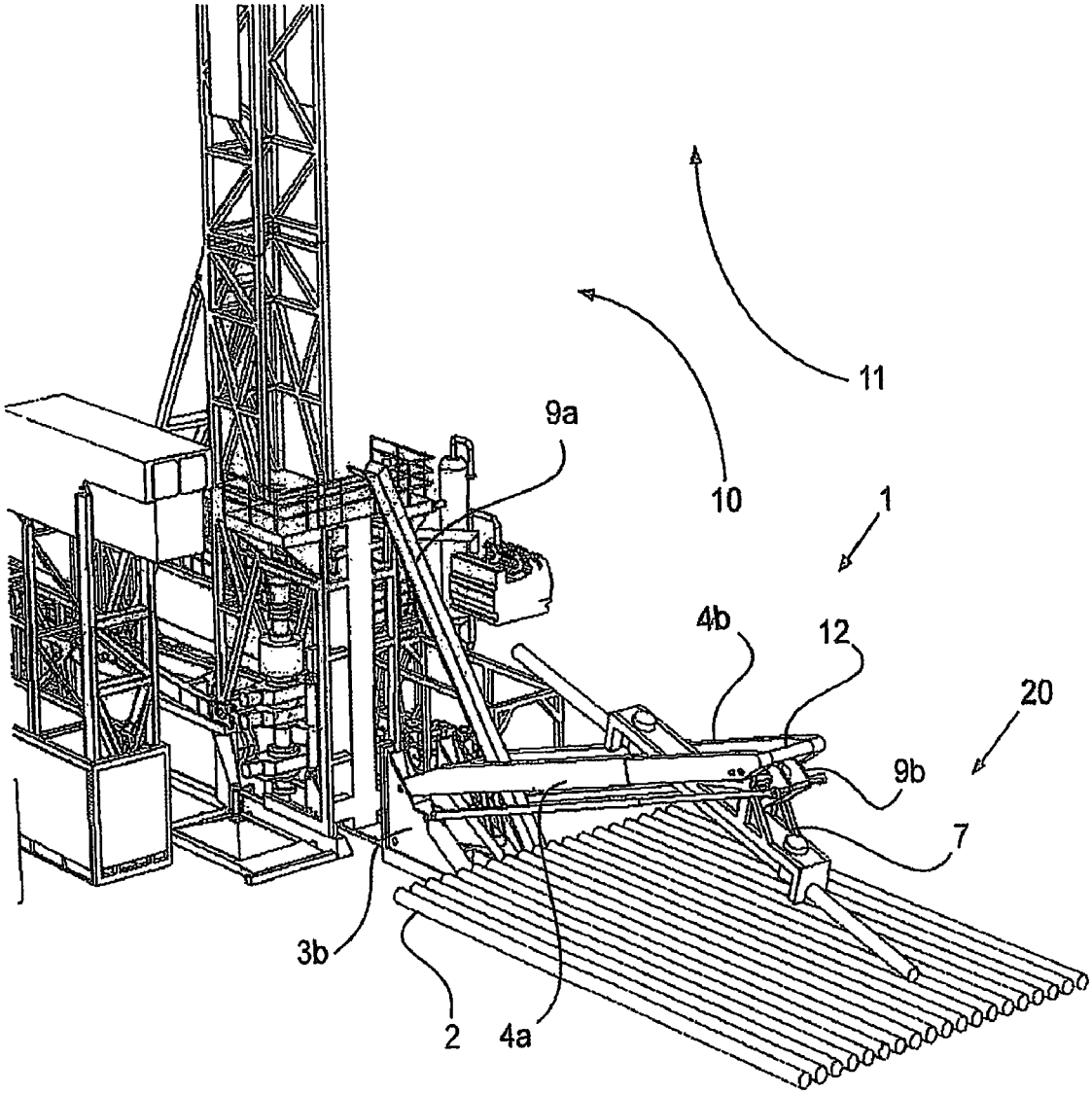
Figure 5:
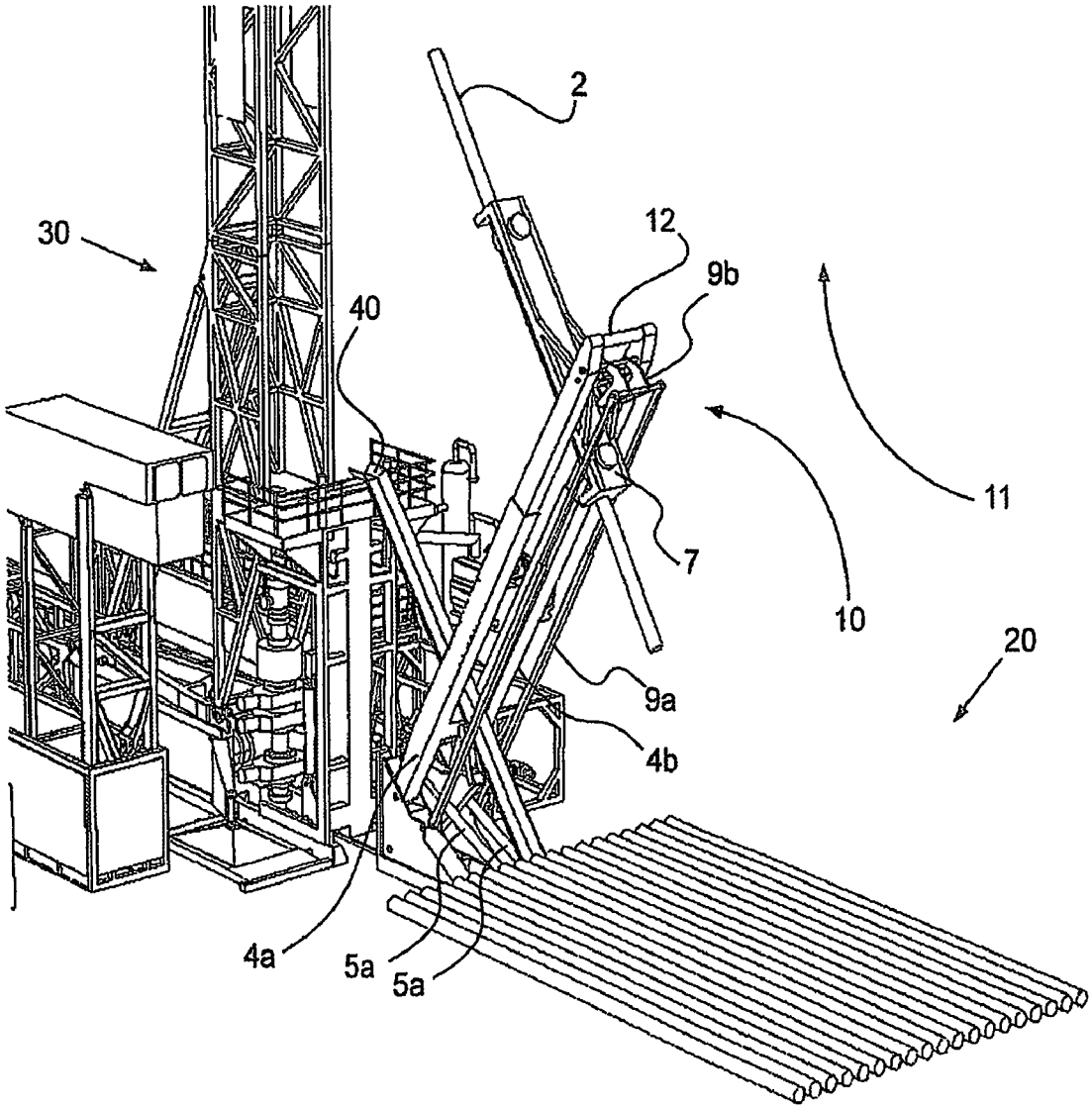
Figure 6:
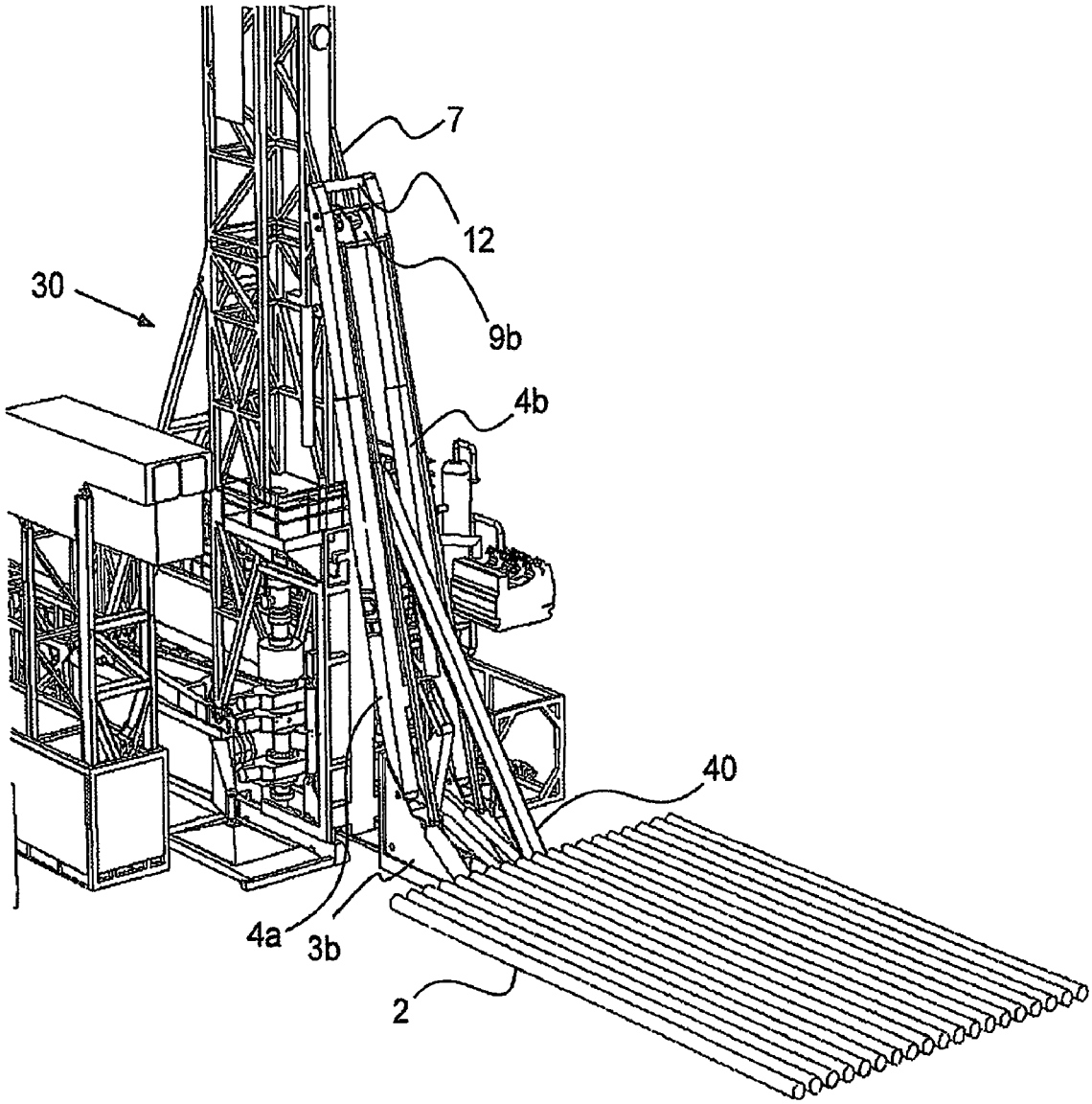
Figure 7:
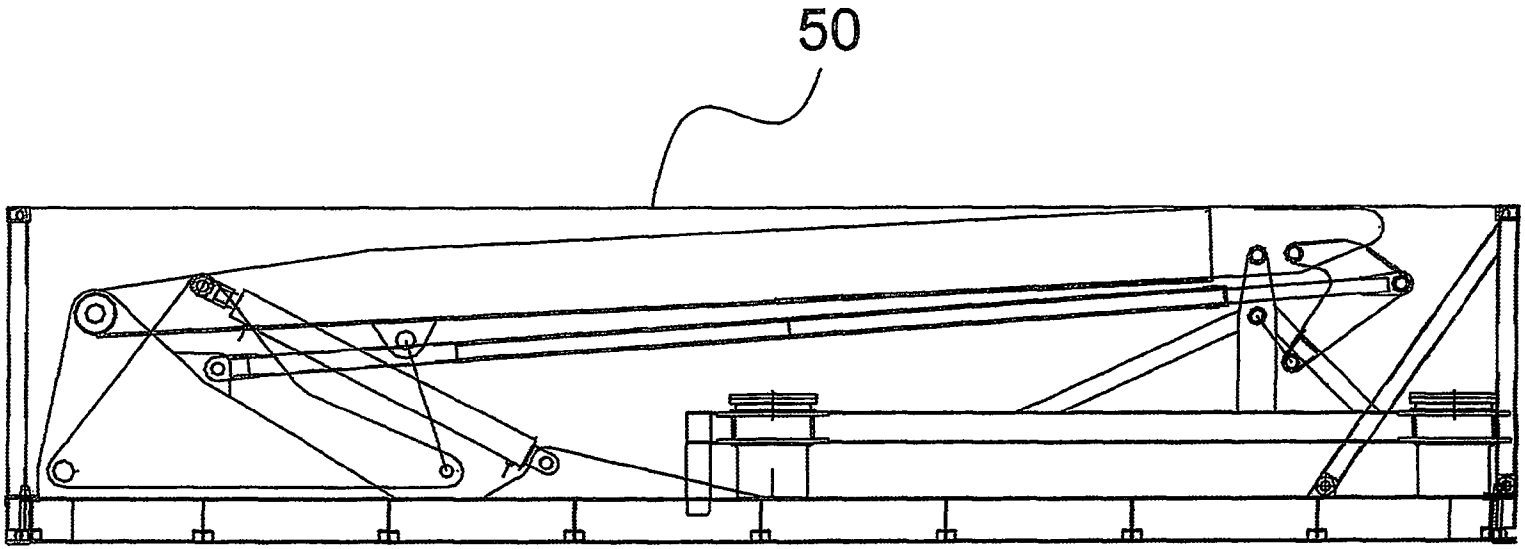

FIG. 1 shows a tubular handling apparatus according to the invention with the tubular in a horizontal first transfer station, FIG. 2 shows the tubular handling apparatus of FIG. 1 with the tubular in a vertical second transfer station, FIG. 3 shows gripper rotation drive means in an enlarged view, FIG. 4 shows the tubular handling apparatus according to the invention in a perspective view with the tubular near a horizontal first transfer station, FIG. 5 shows the tubular handling apparatus according to the invention in a perspective view with the tubular between a horizontal first transfer station and a vertical second transfer station, FIG. 6 shows the tubular handling apparatus according to the invention in a perspective view with the tubular near a vertical second transfer station, FIG. 7 shows the tubular handling apparatus according to the invention in a container.

In FIG. 1 an example of a tubular handling apparatus 1 according to the invention is shown.

Also shown in FIG. 1 is a tubular 2 resting in a horizontal transfer position on a tubular storage station 20 (forming a horizontal first transfer station) of which support frame members 46 are visible in FIGS. 1, 2 and 3.

The apparatus 1 basically comprises a base 3, a boom 4, and a gripper 7 for the tubular 2.

The boom 4 is rotatable with respect to the base 3 around a boom rotation axis 6 between a lowered position, shown in FIG. 1, and a raised position, shown in FIG. 2. As shown the boom 4 here is essentially horizontal in the lowered position and rotated to a near vertical position.

From the FIGS. 4-6 it is clear that the boom 4 in this example comprises two parallel beams 4*a* and 4*b* between which the gripper 7 and the gripped tubular 2 can pass as the boom 4 is rotated. For stability a cross beam 12 is provided at the ends of the two parallel beams 4*a* and 4*b* remote from the base part 3*b*.

The gripper 7 is rotatably attached to the boom 4 and adapted for gripping the tubular 2. The gripper 7 can comprise any suitable gripping means for get hold off and reliable holding the tubular 2. In this example the gripper 7 comprises two spaced apart clamping means 7*a* mounted on a gripper frame 7*b*, which is suspended from the boom 4, preferably near the end thereof.

The gripper frame 7*b* here is an elongated frame, having a longitudinal axis in the direction of the tubular 2 to be gripped.

In the shown embodiment, the base 3 comprises a flat-bed base part 3*d* with ISO freight container corner fittings 3*a*, preferably designed similar to a 40 feet container. Two parallel base parts 3*b* are designed for pivotally attaching and supporting a beam 4*a, b* of the lower end of the boom 4. Base part 3*c* is adapted to support the boom rotation drive means as will be explained below.

The boom 4 is pivotable between the lowered position shown in FIG. 1 and the raised position shown in FIG. 2 by boom rotation drive means 5*a*, 5*b* and 5*c* in a boom rotation direction 10 around the horizontal boom rotation axis 6.

The boom rotation drive means 5*a*-5*c* here comprise two hydraulically actuated cylinders 5*a* (of which one is shown in FIGS. 1 and 2) that are pivotably connected to the base part 3*c* at one end and pivotably to a base linkage member 5*b* at the other end. The base linkage member 5*b* is positioned between the supports 3*b* and is rotatably connected to the base part 3*b* about a rotation axis 5*d*. This rotation axis 5*d* is spaced from the pivotal attachment of the cylinders 5*a*.

Also the base linkage 5*b* is pivotably connected to a rod 5*c* that is pivotably connected to a part of the boom 4 remote from the boom rotation axis 6.

The gripper 7 is rotatable about a gripper rotation axis 8 by gripper rotation drive means 9*a*-9*e* in a gripper rotation direction 11. This direction 11 is opposite to the boom rotation direction 10.

A part of the exemplary gripper rotation drive means 9*a*-9*e* is shown in an enlarged view in FIG. 3.

In this example, as is preferred, the gripper rotation drive means 9*a*-9*e* comprise a kinematic linkage assembly arranged between the base part 3*b* and the gripper 7 and connected to the boom 4. By the presence of such a kinematic linkage no specific powered actuators (such as hydraulic or electric actuators) are needed for effecting the rotation of the gripper 7. In fact the boom 4 is the driven part and the gripper "follows", wherein the gripper motion results from the design of the kinematic linkage. This is very safe and reliable, as linkages can be designed sturdy and reliable. So the problem can be avoided that a powered actuator for the gripper rotation fails or malfunction, while the boom rotation drive means is activated, which could e.g. result in a collision of the tubular with another structure (such as a drilling rig or pipe lay structure).

The kinematic linkage assembly in this example comprises two rods 9*a* (one of which is shown in FIGS. 1-3), each extending along a beam 4*a*, 4*b* of the boom 4.

Each rod 9*a* is connected with one end 9*d* pivotably to the corresponding base part 3*b* and—as can be clearly seen in FIG. 3—with the other end 9*e* pivotably to a rod linkage member 9*b*. The rod linkage member 9*b*, designed here as a plate, is pivotably attached to the boom 4 via rotation axis 9*f*, parallel to pivot axis 8.

In this example also a gripper linkage member 9*c*, here embodied as a rod 9*c*, is pivotably attached, via pivot axis 9*h*, to the gripper frame 7*b* remote from the axis 8. Further the linkage member 9*c* is pivotably connected via pivot axis 9*i*, to the linkage member 9*b*. It can be envisaged to dispense with this member 9*c* and connect rod linkage member 9*b* directly to the frame 7*b*, e.g. via a slot-pin connection.

In the shown design of the boom rotation drive means 5*a*-5*c* and the gripper rotation drive means 9*a*-9*e* the gripper rotation axis 8 is parallel to and spaced from the horizontal boom rotation axis 6. The gripper rotation direction 11 is opposite from the boom rotation direction 10.

The operation of the tubular handling apparatus 1 of the invention is shown in a perspective view in FIGS. 4-6. Here, the tubular handling apparatus 1 moves tubular 2 between a horizontal tubular storage station 20 and a vertical drilling rig structure 30.

In these FIGS. 4-6 also a conventional inclined guide ramp 40 for raising and lowering tubulars 2 is shown. This ramp 40 extends between the storage station 20 and an elevated level 31 of the drilling rig structure 30. As can be seen this ramp 40 passes between the beams 4*a* and 4*b* of the boom 4.

From this perspective view in FIG. 4-6, it is clear that two hydraulic boom rotation drive cylinders 5*a* are present, and two rods 9*a* of the gripper rotation drive means. Also, base parts 3*b* and 3*c* are designed symmetrically on base plate 3*d*.

The beams 4*a, b* of the boom 4 and the rods 9*a* of the gripper rotation drive means 9*a*-9*e* are telescopic. A special drive means could be provided to cause the telescopic motion, but here it is envisaged that e.g. a truck is used to extend or shorten the boom and rods.

The base 3 is here designed as part of an ISO freight container with ISO freight container corner fittings 3*a*.

As the boom 4 and the rods 9*a* are telescopic the entire apparatus can be reduced to a size of an ISO freight container 50, preferably a 40 feet container, as is shown in FIG. 7. Such a container 50 can easily be transported and easily be coupled to another ISO freight container. It is envisaged that the drilling rig structure 30 is provided with ISO corner fittings to which ISO corner fittings of the apparatus 1 can be attached.

The invention claimed is:

1. A tubular handling apparatus for moving tubulars between a substantially horizontal first transfer station and a second transfer station, comprising:

a base, a boom, rotatable with respect to the base between a lowered position and a raised position by a boom rotation drive in a boom rotation direction around a horizontal boom rotation axis, and a gripper, rotatably attached to the boom and adapted for gripping the tubular, the gripper being rotatable about a gripper rotation axis by a gripper rotation drive in a gripper rotation direction, wherein the gripper rotation axis is parallel to and spaced from the horizontal boom rotation axis and the gripper rotation drive provides a gripper rotation direction opposite to the boom rotation direction, and the gripper rotation drive comprises at least one rod, extending along the boom, connected pivotably with one end to the base remote from the horizontal boom rotation axis and connected pivotably with the other end to a rod linkage member that is pivotably attached to the boom, the rod and the gripper, respectively, about respective rotation axes parallel to the gripper rotation axis and the horizontal boom rotation axis.

2. The tubular handling apparatus according to claim 1, wherein the boom rotation drive and the gripper rotation drive are adapted to operate simultaneously, such that the tubular is moved simultaneously in the boom rotation direction from the lower position to the raised position and in the gripper rotation direction.

3. The tubular handling apparatus according to claim 1, wherein the boom comprises two beams between which the gripper and the gripped tubular pass upon rotation of the boom.

4. The tubular handling apparatus according to claim 3, wherein a cross beam is provided at the ends of the two beams remote from the base.

5. The tubular handling apparatus according to claim 1, wherein the rod linkage is attached to the gripper via a gripper linkage member, linking the rod linkage member.

6. The tubular handling apparatus according to claim 1, wherein the rod linkage member is a plate.

7. The tubular handling apparatus according to claim 5, wherein the gripper linkage member is a rod.

8. The tubular handling apparatus according to claim 1, wherein the boom rotation drive comprises one or more hydraulically actuated cylinders.

9. The tubular handling apparatus according to claim 1, wherein the boom rotation drive comprises a base linkage member that is pivotably connected to the base via an interpositioned pivotable rod to a part of the boom remote from the base, and one or more actuators are arranged between the base and the base linkage member.

10. The tubular handling apparatus according to claim 1, wherein the boom is telescopic.

11. The tubular handling apparatus according to claim 1, wherein the rod of the gripper rotation drive is telescopic.

12. The tubular handling apparatus according to claim 1, wherein the base is designed as part of an ISO freight container, and has ISO freight container corner fittings.

13. The tubular handling apparatus according to claim 1, wherein the apparatus is telescopic to a size of an ISO freight container.

14. The tubular handling apparatus according to claim 12, wherein the apparatus can be coupled to another ISO freight container.

15. The tubular handling apparatus according to claim 1, wherein the substantially horizontal first transfer station is a tubular storage station.

16. The tubular handling apparatus according to claim 1, wherein the second transfer station is part of a drilling rig structure, a marine pipe lay structure or a crane.

17. The tubular handling apparatus according to claim 1, wherein the tubular is one of an oil well or a water well tubular or rod, a drill pipe, a drill collar, a casing, a production tubing, a sucker rod, a pump column pipe, a logging tool or a bottom hole assembly, a pipeline joint.

18. A drilling rig comprising:

a drilling rig structure, a tubular transfer station associated with said drilling rig structure, a hoisting device for raising and lowering a string of interconnected tubulars, a tubular storage station, a substantially horizontal tubular transfer station, and the tubular handling apparatus according to claim 1.

19. A marine pipe lay system comprising:

a pipe lay tower, a tubular transfer station associated with said tower, a tubular storage station a substantially horizontal tubular transfer station, and the tubular handling apparatus according to claim 1.

20. A method for handling tubulars between a substantially horizontal first transfer station and a second transfer station, said method comprising:

providing and utilizing the apparatus according to claim 1;

gripping the tubular by the gripper, when said tubular is in a transfer station, rotating the boom with respect to a base between a lowered position and a raised position around a horizontal boom rotation axis and rotating the gripper about a gripper rotation axis, so that the tubular arrives at another transfer station.

21. The method for handling tubulars according to claim 20, wherein the rotation of the gripper and the rotation of the boom occur simultaneously.

22. The method for handling tubulars according to claim 20, as part of a drilling operation.

23. The method for handling tubulars according to claim 20, as part of a pipe laying operation.

24. The tubular handling apparatus according to claim 20, wherein the apparatus can be coupled to another ISO freight container.

* * * * *